US008620193B2

(12) United States Patent
Yamamoto et al.

(10) Patent No.: US 8,620,193 B2
(45) Date of Patent: Dec. 31, 2013

(54) IMAGE FORMING APPARATUS AND CONTROL METHOD

(75) Inventors: Yuichi Yamamoto, Abiko (JP); Hiroaki Tomiyasu, Toride (JP); Shinnosuke Iwadate, Toride (JP); Takahiko Yamaoka, Kashiwa (JP); Hiromi Shimura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 275 days.

(21) Appl. No.: 13/279,598

(22) Filed: Oct. 24, 2011

(65) Prior Publication Data

US 2012/0134715 A1 May 31, 2012

(30) Foreign Application Priority Data

Nov. 26, 2010 (JP) ..... 2010-264292

(51) Int. Cl.
*G03G 15/08* (2006.01)

(52) U.S. Cl.
USPC ..... 399/257; 399/38

(58) Field of Classification Search
USPC ..... 399/38, 42, 43, 58–65, 252, 257
See application file for complete search history.

(56) References Cited

U.S. PATENT DOCUMENTS 6,868,240 B2 * 3/2005 Ozawa et al. ..... 399/43

FOREIGN PATENT DOCUMENTS

JP 09-034243 A 2/1997

* cited by examiner

*Primary Examiner* — Hoan Tran
(74) *Attorney, Agent, or Firm* — Fitzpatrick, Cella, Harper & Scinto

(57) ABSTRACT

An image forming apparatus which performs toner discharge control for held toners of respective colors, comprises: an image carrier; a transfer member on which toner images of the respective colors formed on the image carrier are transferred and superposed; a calculation unit configured to calculate toner amounts used to form the toner images of the respective colors; and a control unit configured to superpose toners of at least two colors onto the transfer member when the toner amounts calculated by the calculation unit are smaller than a predetermined consumption amount, wherein the control unit decides a combination of colors of the toners to be superposed in accordance with differences between the toner amounts and the predetermined consumption amount.

7 Claims, 7 Drawing Sheets

IMAGE FORMING APPARATUS AND CONTROL METHOD

BACKGROUND OF THE INVENTION

1. Field of the Invention

The present invention relates to an image forming apparatus and control method. Particularly, the present invention relates to optimization of the downtime of a discharge mode in which a deteriorated developer is discharged when many images that consume a small amount of toner are output.

2. Description of the Related Art

Recently, electrophotographic image forming apparatuses (for example, copying machine, printer, and FAX machine) are rapidly shifting from monochrome apparatuses to color ones. In a color image forming apparatus, a two-component developer containing a non-magnetic toner and magnetic carrier is used in a developing device within a photosensitive drum. The developing device is replenished with toner, reducing the user running cost. The developer in the developing device is stirred by a stirring screw to charge the toner. The developer is then supplied to a developing sleeve and develops an image on the photosensitive drum.

At this time, if images small in toner consumption amount are output successively, toner is repetitively rubbed and stirred for a long time, and deteriorates. To output high-quality images for a long period, the deteriorated toner needs to be replaced with a new one. Proposals for it have conventionally been made.

Japanese Patent Laid-Open No. 09-034243 describes a discharge mode in which a deteriorated developer is discharged when many images that consume a small amount of toner are printed. In the discharge mode, a toner band is generally formed by superposing all colors on an intermediate transfer belt.

When a toner band is formed by superposing all colors (for example, four colors) on the intermediate transfer belt in the discharge mode, the downtime of the discharge mode itself can be reduced. However, the toner band of the four superposed colors needs to be cleaned without generating a cleaning failure. This requires high cleaning performance for the intermediate transfer belt. If the cleaning performance for the intermediate transfer belt is not high enough to clean the toner band of the four superposed colors at once, the number of toner band colors to be superposed needs to be decreased to two or three. However, a toner band to be formed is created in accordance with the average density of images which were output before. If colors are always superposed in the same combination, the downtime of the system may be prolonged depending on the length of a toner band to be formed.

SUMMARY OF THE INVENTION

According to one aspect of the present invention, there is provided an image forming apparatus which performs toner discharge control for held toners of respective colors, comprising: an image carrier; a transfer member on which toner images of the respective colors formed on the image carrier are transferred and superposed; a calculation unit configured to calculate toner amounts used to form the toner images of the respective colors; and a control unit configured to superpose toners of at least two colors onto the transfer member when the toner amounts calculated by the calculation unit are smaller than a predetermined consumption amount, wherein the control unit decides a combination of colors of the toners to be superposed in accordance with differences between the toner amounts and the predetermined consumption amount.

According to another aspect of the present invention, there is provided a method of controlling an image forming apparatus which includes an image carrier and a transfer member on which toner images of respective colors formed on the image carrier are transferred and superposed, and performs toner discharge control for held toners of the respective colors, comprising: a calculation step of calculating toner amounts used to form the toner images of the respective colors; and a control step of superposing toners of at least two colors onto the transfer member when the toner amounts calculated in the calculation step are smaller than a predetermined consumption amount, wherein in the control step, a combination of colors of the toners to be superposed is decided in accordance with differences between the toner amounts and the predetermined consumption amount.

The present invention can reduce the downtime by changing a combination of colors to be superposed in accordance with the length of a toner band to be generated (amount of toner to be discharged) when forming a toner band by superposing a plurality of colors.

Further features of the present invention will become apparent from the following description of exemplary embodiments (with reference to the attached drawings).

DESCRIPTION OF THE EMBODIMENTS

First Embodiment

Figure 1:
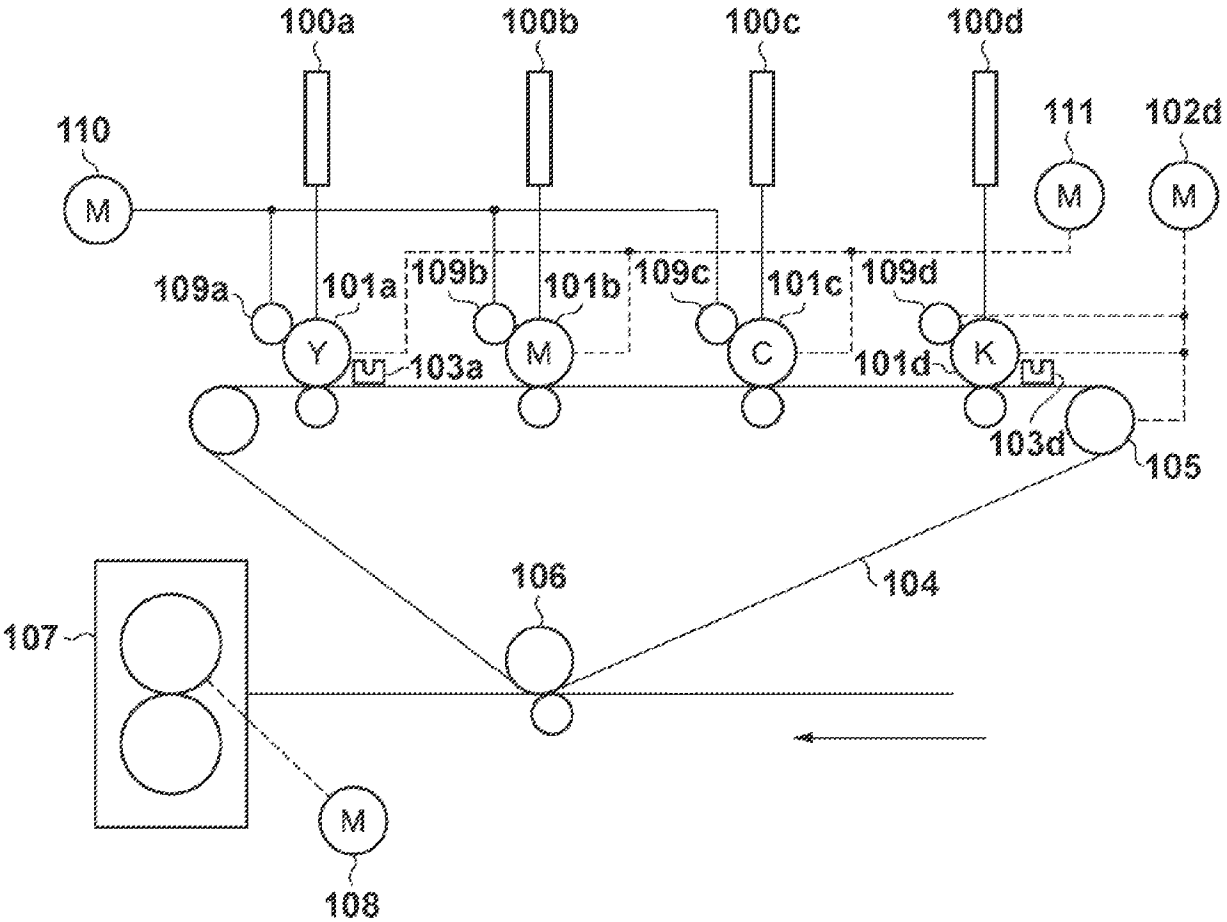
FIG. 1 is a view exemplifying the arrangement of an image forming apparatus according to the first embodiment.

FIG. 1 is a view showing the arrangement of a color image forming apparatus according to the first embodiment. The color image forming apparatus (to be simply referred to as an image forming apparatus) can handle four color toners, and includes yellow, magenta, cyan, and black image forming units. These four colors will be described as Y, M, C, and K. Photosensitive drums 101*a*, 101*b*, 101*c*, and 101*d* each serving as an image carrier form electrostatic latent images (a, b, c, and d correspond to Y, M, C, and K, respectively). A color photosensitive drum driving motor 111 drives the photosensitive drums 101*a* to 101*c*, and a BK photosensitive drum driving motor 102*d* drives the photosensitive drum 101*d*. The BK photosensitive drum driving motor 102*d* drives even a developing device 109*d* and intermediate transfer roller 105. A color developing driving motor 110 drives developing devices 109*a* to 109*c*. Laser scanners 100*a* to 100*d* perform exposure in accordance with image signals, forming electrostatic latent images on the photosensitive drums 101*a* to 101*d*. Toner images formed on the photosensitive drums 101*a* to 101*d* are sequentially transferred onto an intermediate transfer belt 104 serving as a transfer member. The intermediate transfer roller 105 rotates to move the intermediate transfer belt 104. A transfer roller 106 transfers, onto conveyed paper at once, the toner images formed on the intermediate transfer belt 104. A fixing driving motor 108 drives fixing rollers arranged in a fixing unit 107.

Upon receiving a print instruction, the image forming apparatus sends image signals of the respective colors to the laser scanners 100*a* to 100*d*, forming electrostatic latent images on the photosensitive drums 101*a* to 101*d*. The developing devices (not shown) develop the electrostatic latent images on the photosensitive drums 101*a* to 101*d* with toners. The intermediate transfer belt 104 rotates clockwise, and the toner images formed on the photosensitive drums 101*a* to 101*d* are sequentially transferred onto the intermediate transfer belt 104.

Paper is conveyed from a paper feed cassette (not shown) in a direction indicated by the arrow. The toner images formed on the intermediate transfer belt are transferred onto the paper at the position of the transfer roller 106. The toner images are fixed onto the paper (printing medium) by the heat of the fixing unit 107. The paper is then discharged outside the apparatus.

Note that the above-described basic image forming operation is merely an example, and the present invention is not limited to this arrangement.

[Configuration of Control System]

Figure 2:
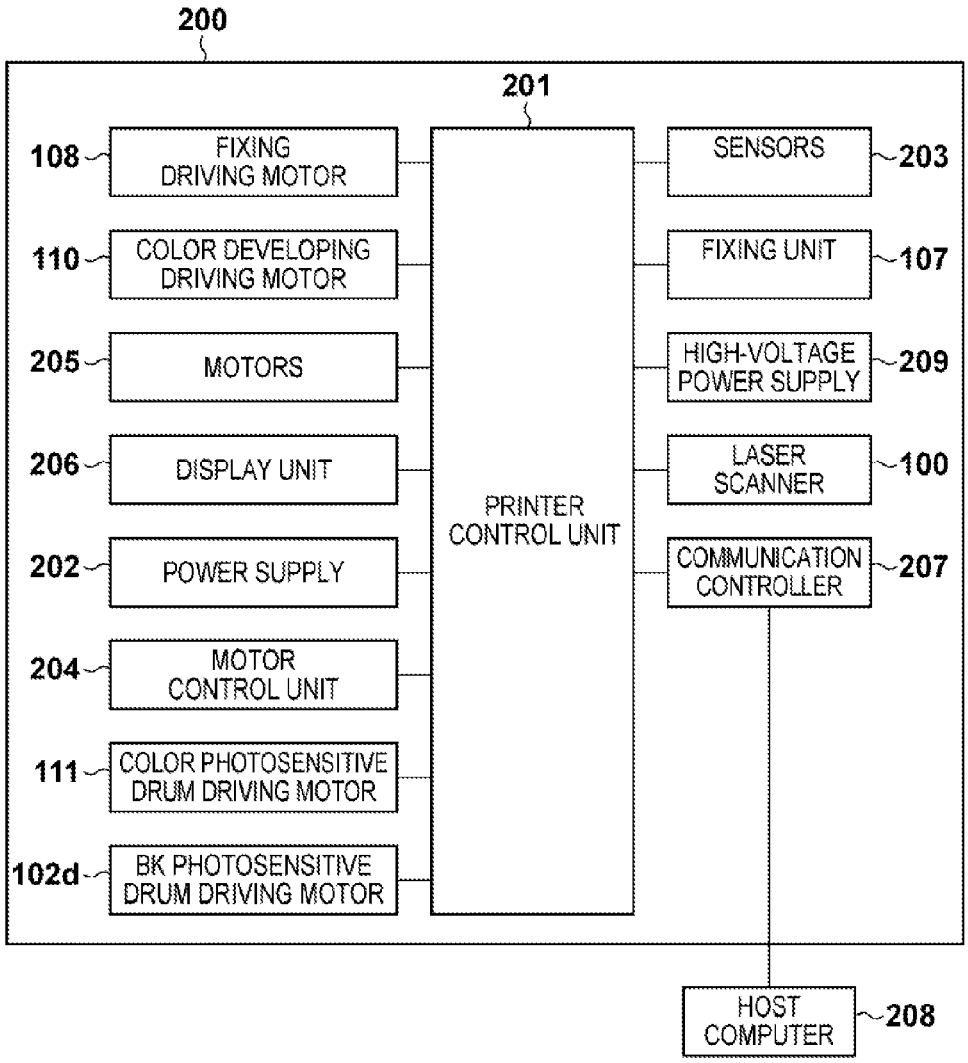
FIG. 2 is a block diagram showing the schematic configuration of the control system of the image forming apparatus.

FIG. 2 is a block diagram showing the schematic configuration of the control system of the apparatus. A printer unit 200 performs print processing in the color image forming apparatus. A printer control unit 201 controls respective devices in the printer unit 200. A power supply 202 supplies power to respective devices in the printer. Sensors 203 detect the states of respective units in the printer. A motor control unit 204 includes circuits such as a DSP (Digital Signal Processor), ASIC (Application Specific Integrated Circuit), and CPU. Examples of control by the mounted circuits are phase switching control based on a rotor position signal from a DC brushless motor (not shown), motor start/stop control based on a control signal, and speed control using a speed signal from the printer control unit 201 and a speed detector (not shown). The printer unit 200 includes the color photosensitive drum driving motor 111 and BK photosensitive drum driving motor 102*d*, and the motor control unit 204 controls their speeds. Motors 205 drive respective devices in the printer. A display unit 206 notifies the user of the operating state of the printer. A communication controller 207 controls communication between the printer and a host computer. A host computer 208 transfers data to be printed to the printer. A high-voltage power supply 209 applies a voltage higher than that from the power supply 202 in the printer unit 200.

[Toner Discharge Control]

Developer discharge control in the image forming apparatus will be explained. The image forming apparatus includes drum units (not shown) containing the photosensitive drums 101*a* to 101*d* and the developing devices 109*a* to 109*d*. After replenishment, toner in a developer held in the drum unit is sequentially replaced during processes of charging by stirring and rubbing, and development. In the series of processes, the amount of replaced toner is small for an image small in average toner consumption amount, and toner is excessively charged. To prevent excessive charging and deterioration of the image quality, toner is replaced by forcibly consuming it as a toner band at a desired timing.

As a toner amount to be consumed in discharge control, when a desired ratio of the image area (toner coverage) for consumption is 5% and the actual average ratio of the image area is X %, the toner amount needs to be consumed by (5−X) %. When 100 images are output in discharge control, a toner amount corresponding to ((5−X) %×100 images) needs to be discharged as a band. The value expressed as the ratio of the image area is, for example, a ratio to an entire 1-page image. More specifically, black having 100% ratio of the image area indicates that all dots contained in the page are printed with a black toner.

[Discharge Toner Amount]

Figure 3:
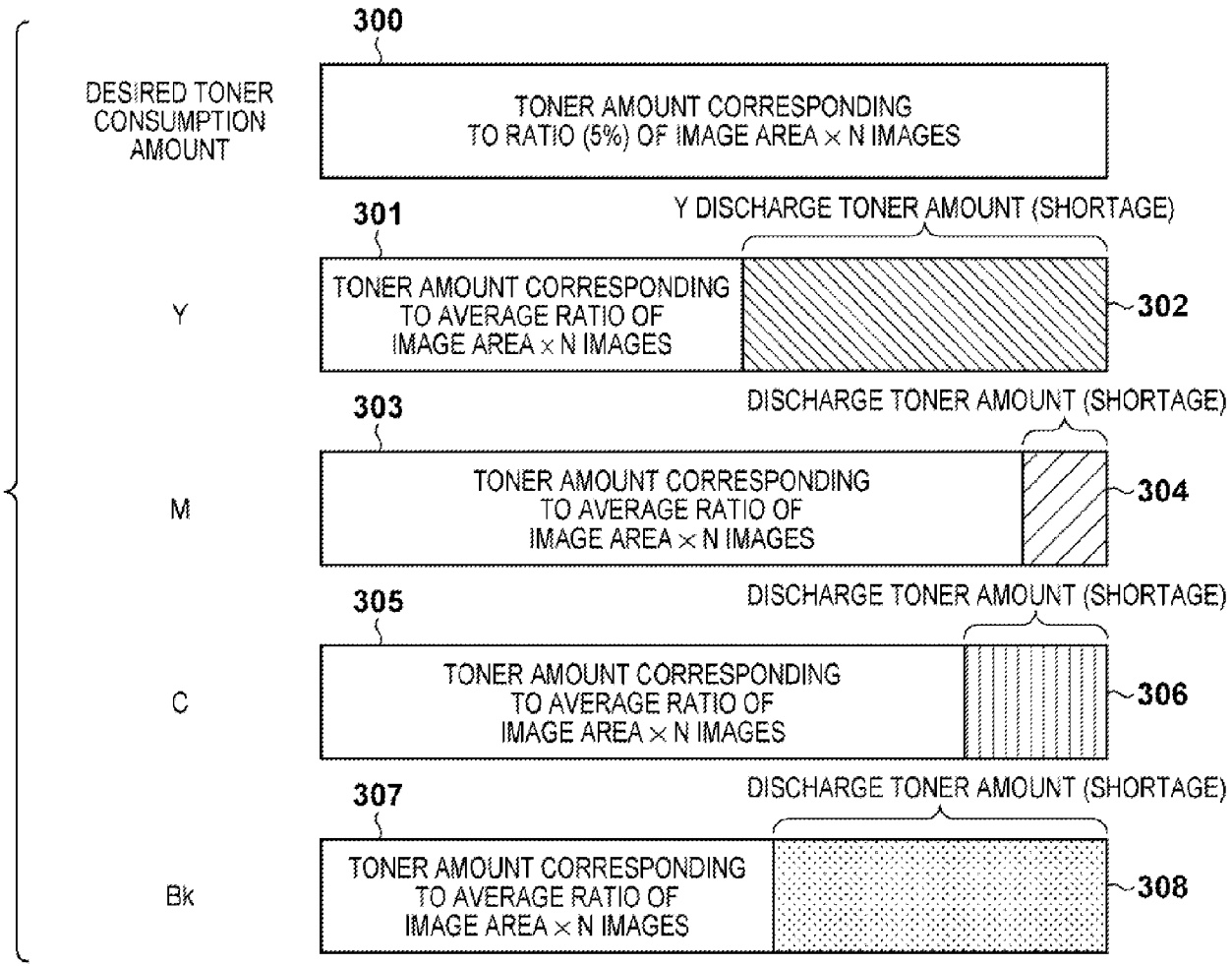
FIG. 3 is a view showing the length of a toner band to be formed.

The toner amount to be discharged will be explained with reference to FIG. 3. A toner consumption amount 300 in FIG. 3 is set as a desired toner consumption amount for each color when N images are output at 5% ratio of the image area. Assume that the toner consumption amount 300 is defined in advance as a predetermined value and held. In this case, a toner discharge amount 302 (that is, a shortage from the desired toner consumption amount) of Y toner to be discharged in discharge control is a difference obtained by subtracting, from the toner consumption amount 300, a toner amount 301 corresponding to the average ratio of the image area of Y×N images. The toner amounts of M, C, and K toners handled in the image forming apparatus are also obtained by the same calculation. FIG. 3 shows the toner consumption amounts and discharge toner amounts (shortages) of the respective colors. Note that the average ratio of the image area is obtained for each color and has a specific value. In the embodiment, the toner amounts of the respective colors consumed for the same toner band length are equal. If the toner amounts of the respective colors consumed for the same toner band length differ from each other, the length is calculated in accordance with the ratio.

[Combination of Toners in Discharge Control]

Control of reducing the downtime by changing a combination of coloring materials to be superposed when toners are discharged between image forming processes will be described with reference to FIG. 4. The embodiment assumes that the cleaning performance for the intermediate transfer belt 104 is high enough to clean at least two color toners.

Figure 4:
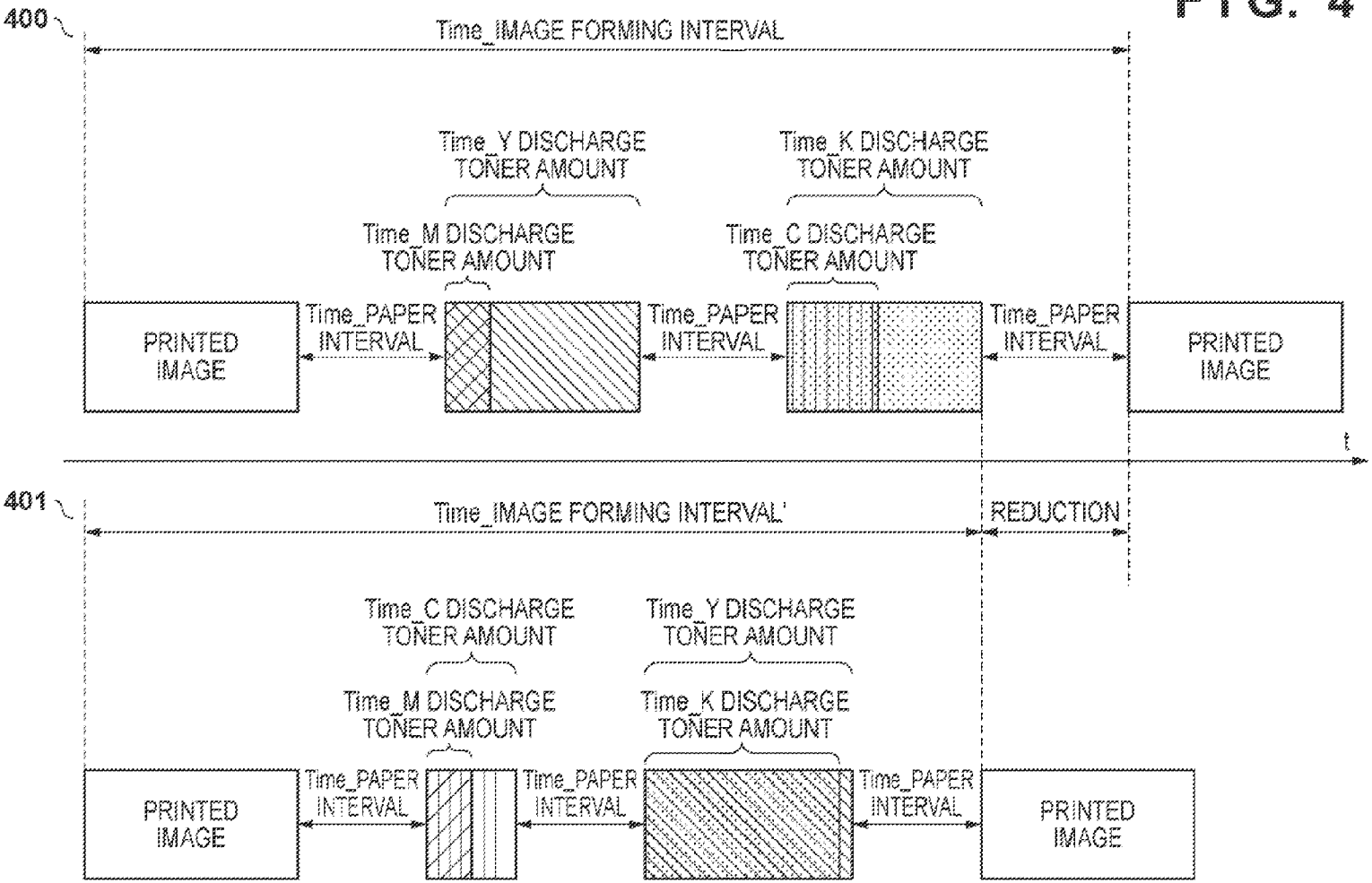
FIG. 4 is a view showing the downtime in the discharge mode according to the first embodiment.

When Y and M toners are superposed and C and K toners are superposed in discharging toner discharge amounts described with reference to FIG. 3 between image forming processes, Time_image forming interval serving as the interval (time) between image forming processes as represented by 400 in FIG. 4 is given by (Time_image forming interval)=(image forming time)+(Time_paper interval)+(Time_*Y* discharge toner amount)+(Time_paper interval)+(Time_*K* discharge toner amount)+(Time_paper interval)

image forming time: time taken to form an image

Time_paper interval: time taken to adjust the toner output position

Time_X discharge toner amount (X is one of C, M, Y, and K): time taken to discharge the amount of toner of each color In the above equation, Y and M toners are superposed, and C and K toners are superposed. A time required for a larger amount to be discharged out of Y and M toner amounts is used. This also applies to a combination of C and K toners. In the example of 400 in FIG. 4, the Y toner amount to be discharged is larger than the M toner amount to be discharged, so the Y toner discharge time is required. Similarly, the K toner discharge time is required in the relationship between C and K.

To the contrary, when a combination of colors to be superposed is changed in accordance with their toner discharge amounts, Time_image forming interval' is given by the following equation, as represented by 401 of FIG. 4:

(Time_image forming interval)'=(image forming time)+(Time_paper interval)+(Time_*C* discharge toner amount)+(Time_paper interval)+(Time_Y discharge toner amount)+(Time_paper interval)

In this case, C and M are superposed, and Y and K are superposed. At this time, the toner discharge amounts of the respective colors are not changed, but a combination of colors differs from the above one. More specifically, a combination is determined by selecting two colors in order from a color whose toner discharge amount is small. This combination shortens Time_image forming interval' based on the toner discharge amounts of the respective colors. The difference between Time_image forming interval and Time_image forming interval' serves as the downtime reducible time. Note that two colors may be selected and combined in order from a color whose toner discharge amount is large.

In this way, the downtime can be reduced by changing a combination of colors to be superposed in accordance with the toner amount to be discharged.

[Processing Sequence (Combination of Two Colors)]

Figure 6:
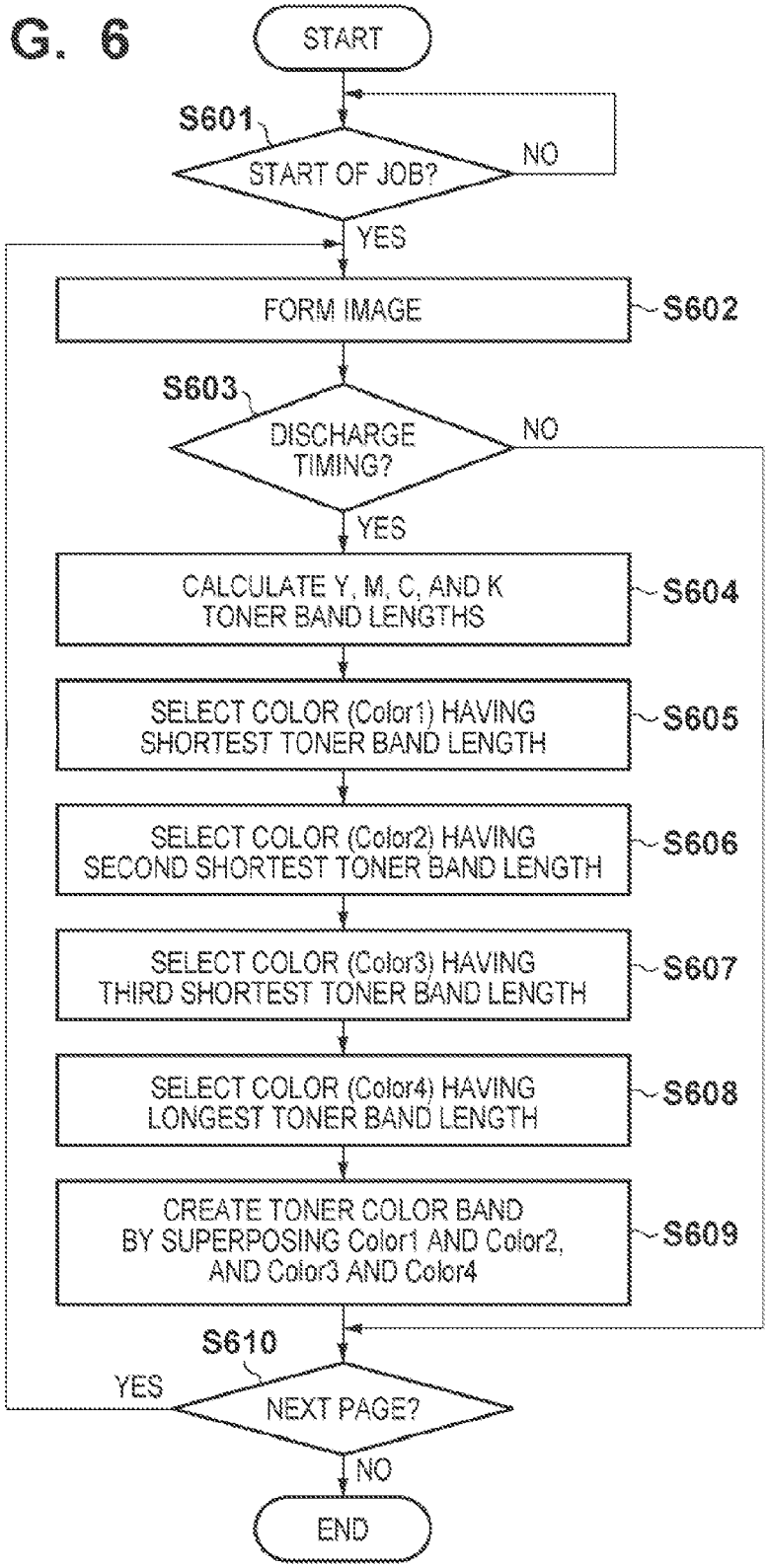
FIG. 6 is a flowchart according to the first embodiment.

An operation for the example of a two-color combination described with reference to FIG. 4 will be explained with reference to the flowchart of FIG. 6. Note that the printer control unit 201 controls this processing sequence.

If the external host computer 208 or an operation unit (not shown) issues a print request in step S601 (YES in step S601), the printer control unit 201 performs pre-processing necessary for image formation and starts image formation (step S602). After the end of outputting each page in response to the print request, the printer control unit 201 determines whether the toner discharge timing has come (step S603). If no toner discharge timing has come (NO in step S603), the printer control unit 201 determines whether there is the next page (step S610). If there is the next page (YES in step S610), the process returns to step S602 to continue image formation. If there is no next page (NO in step S610), the printer control unit 201 performs necessary post-processing, ending the image forming operation.

If toner discharge is to be performed (YES in step S603), the printer control unit 201 calculates a toner amount to be discharged, as described with reference to FIG. 3 (step S604). In steps S605 to S608, the printer control unit 201 sequentially selects colors from one whose toner band is short (toner amount is small), as Color1, Color2, Color3, and Color4. The printer control unit 201 decides a combination of Color1 and Color2 and a combination of Color3 and Color4 as combinations of toners to be superposed, and performs toner discharge (step S609). After the end of toner discharge, the printer control unit 201 determines whether there is the next page (step S610). If there is the next page (YES in step S610), the process returns to step S602 and the printer control unit 201 continues image formation. The printer control unit 201 performs necessary post-processing if there is no next page (NO in step S610), ending the image forming operation.

Second Embodiment

The second embodiment will explain control of further reducing the downtime by increasing the number of colors to be superposed on a toner band to be formed. The number of superposition colors of toners to be discharged can be increased in accordance with the cleaning performance for an intermediate transfer belt 104, details of which will be described below.

[Combination of Three Color Toners]

Figure 5:
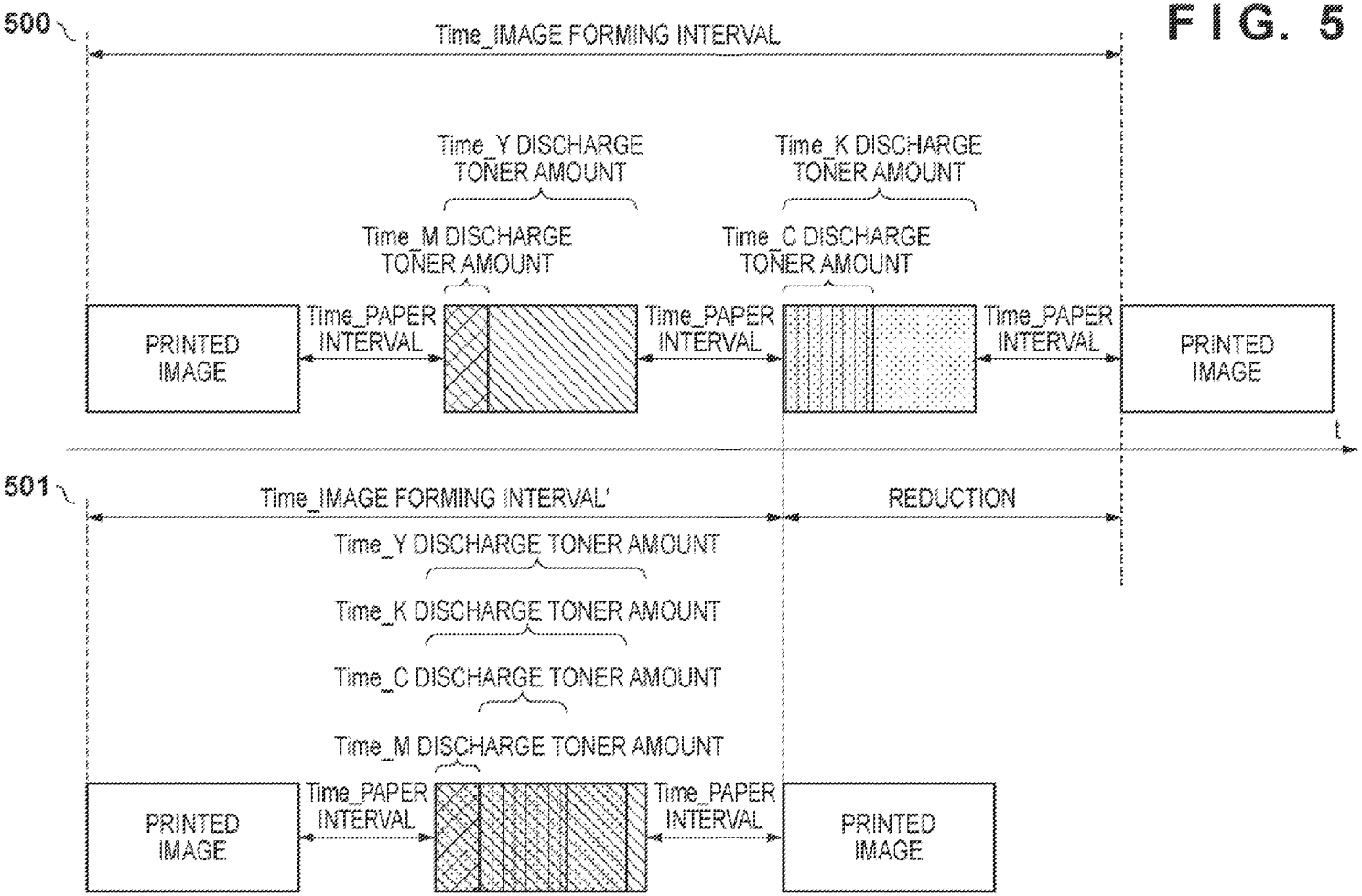
FIG. 5 is a view showing the downtime in the discharge mode according to the second embodiment.

Control of further reducing the downtime by superposing three colors when a toner band is formed between image forming processes will be described with reference to FIG. 5. When discharging toner discharge amounts described with reference to FIG. 3 between image forming processes, Y and M toners are superposed and C and K toners are superposed as represented by 500 in FIG. 5. This is identical to 400 in FIG. 4.

When the cleaning performance for the intermediate transfer belt 104 is high enough to satisfactorily clean it even if three color toners are superposed, the downtime of the image forming apparatus can be further reduced by changing a combination of colors to be superposed in accordance with their toner discharge amounts.

First, an amount by which each color toner needs to be discharged is obtained, and a time necessary for the discharge is calculated. Based on the calculated values, the necessary time of a color (Y) having the longest discharge necessary time among the respective colors is compared with the sum of the necessary time of a color (M) having the shortest discharge necessary time and that of a color (C) having the second shortest discharge necessary time. If the longest time of the color (Y) is longer than the sum of the shortest time of the color (M) and the second shortest time of the color (C), the color (Y) having the longest time, a color (K) having the second longest time, and the color (M) having the shortest time are superposed. After the end of discharging the amount of toner of the shortest-time color (M), the color (C) having the second shortest time is discharged successively. Hence, toners of one to three colors are discharged at any position during toner discharge control. Note that it is also possible to discharge a toner of a second shortest-time color before a toner of a shortest-time color and then discharge the toner of the shortest-time color. With this combination, Time_image forming interval" is given by (Time_image forming interval)"=(image forming time)+(Time_paper interval)+(Time_Y discharge toner amount)+(Time_paper interval)

Based on the toner discharge amounts of the respective colors, the difference between Time_image forming interval and Time_image forming interval" serves as the downtime reducible time.

[Processing Sequence (Combination of Three Colors)]

Figure 7:
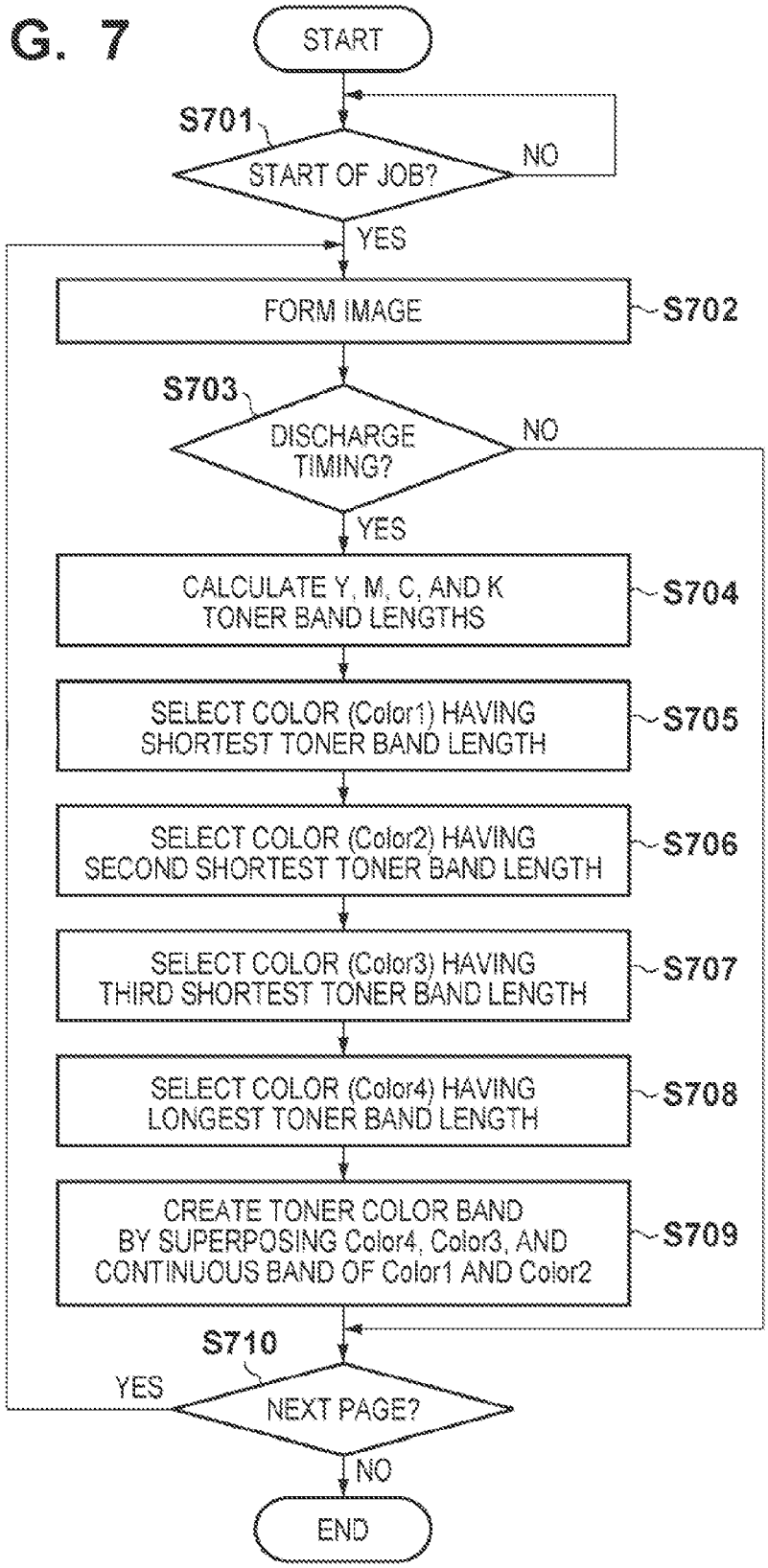
FIG. 7 is a flowchart according to the second embodiment.

An operation for the example of a three-color combination described with reference to FIG. 5 will be explained with reference to the flowchart of FIG. 7. Note that a printer control unit 201 controls this processing sequence.

If an external host computer 208 or an operation unit (not shown) issues a print request in step S701 (YES in step S701), the printer control unit 201 performs pre-processing necessary for image formation and starts image formation (step S702). After the end of outputting each page in response to the print request, the printer control unit 201 determines whether the toner discharge timing has come (step S703). If no toner discharge timing has come (NO in step S703), the printer control unit 201 determines whether there is the next page (step S710). If there is the next page (YES in step S710), the process returns to step S702 to continue image formation. The printer control unit 201 performs necessary post-processing if there is no next page (NO in step S710), ending the image forming operation.

If toner discharge is to be performed (YES in step S703), the printer control unit 201 calculates a toner amount to be discharged, as described with reference to FIG. 3 (step S704). In steps S705 to S708, the printer control unit 201 sequentially selects colors from one whose toner band is short, as Color1, Color2, Color3, and Color4. Then, the printer control unit 201 performs toner discharge by superposing three colors because the downtime can be further shortened by superposing Color4, Color3, and a continuous band of Color1 and Color2 (step S709). More specifically, Color4, Color3, and Color2 are discharged first. After the end of discharging a toner of Color 2, Color1 is successively discharged and superposed on Color3 and Color4. After the end of toner discharge, the printer control unit 201 determines whether there is the next page (step S710). If there is the next page (YES in step S710), the process returns to step S702 and the printer control unit 201 continues image formation. If there is no next page (NO in step S710), the printer control unit 201 performs necessary post-processing, ending the image forming operation.

In the above embodiments, two or three color toners are superposed. However, even when a larger number of color toners are superposed in accordance with the cleaning performance for the intermediate transfer belt 104, the downtime can be reduced by executing the same control as the above one. If there is a toner which need not be discharged, the same control as the above one can be performed for only a toner which needs to be discharged, thereby reducing the downtime.

In the above embodiments, four color toners are handled. However, the present invention is not limited to this, and the number of toner colors processable in the image forming apparatus may be five or more. When a plurality of image forming units (for example, two black image forming units) are arranged for the same color toner, the present invention can be applied by performing different toner discharge control operations for the respective image forming units. Even in this case, the downtime of the image forming apparatus can be reduced by combining toners in accordance with the cleaning performance.

Aspects of the present invention can also be realized by a computer of a system or apparatus (or devices such as a CPU or MPU) that reads out and executes a program recorded on a memory device to perform the functions of the above-described embodiment(s), and by a method, the steps of which are performed by a computer of a system or apparatus by, for example, reading out and executing a program recorded on a memory device to perform the functions of the above-described embodiment(s). For this purpose, the program is provided to the computer for example via a network or from a recording medium of various types serving as the memory device (for example, computer-readable medium).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2010-264292, filed Nov. 26, 2010, which is hereby incorporated by reference herein in its entirety.

What is claimed is:

1. An image forming apparatus which performs toner discharge control for held toners of respective colors, comprising:

an image carrier;

a transfer member on which toner images of the respective colors formed on said image carrier are transferred and superposed;

a calculation unit configured to calculate toner amounts used to form the toner images of the respective colors; and a control unit configured to superpose toners of at least two colors onto said transfer member when the toner amounts calculated by said calculation unit are smaller than a predetermined consumption amount, wherein said control unit decides a combination of colors of the toners to be superposed in accordance with differences between the toner amounts and the predetermined consumption amount.

2. The apparatus according to claim 1, wherein said control unit sets, as an upper limit, the number of colors cleanable by cleaning performance for a toner image transferred onto said transfer member, and decides the number of toner colors to be superposed on said transfer member.

3. The apparatus according to claim 2, wherein the cleaning performance can clean a toner image transferred by superposing toners of at least two colors onto said transfer member.

4. The apparatus according to claim 2, wherein toners of four colors are held as the toners of the respective colors, and when deciding a combination of the toners of the respective colors, said control unit superposes, of the toners of the four colors, a toner having a largest difference between the toner amount and the predetermined consumption amount and a toner having a second largest difference, and superposes a toner having a smallest difference and a toner having a second smallest difference.

5. The apparatus according to claim 2, wherein toners of four colors are held as the toners of the respective colors, the cleaning performance can clean a toner image transferred by superposing toners of at least three colors onto said transfer member, and when a difference of a toner having a largest difference between the toner amount and the predetermined consumption amount among the toners of the four colors is larger than a sum of a difference of a toner having a smallest difference and a difference of a toner having a second smallest difference in deciding a combination of the toners of the respective colors, said control unit superposes the toner having the largest difference and a toner having a second largest difference, further superposes one of the toner having the smallest difference and the toner having the second smallest difference, and after an end of discharging said one toner, superposes the other toner.

6. The apparatus according to claim 1, wherein when deciding a combination of the toners of the respective colors, said control unit selects and superposes a plurality of colors in order from a color having a large or small difference between the toner amount and the predetermined consumption amount.

7. A method of controlling an image forming apparatus which includes an image carrier and a transfer member on which toner images of respective colors formed on the image carrier are transferred and superposed, and performs toner discharge control for held toners of the respective colors, comprising:

a calculation step of calculating toner amounts used to form the toner images of the respective colors; and a control step of superposing toners of at least two colors onto said transfer member when the toner amounts calculated in the calculation step are smaller than a predetermined consumption amount, wherein in the control step, a combination of colors of the toners to be superposed is decided in accordance with differences between the toner amounts and the predetermined consumption amount.

* * * * *